US005411140A

United States Patent [19]

Byer

[11] Patent Number: 5,411,140

[45] Date of Patent: May 2, 1995

[54] PRODUCT PACKAGE WITH MATCHING INDICIA AND RECESS

[75] Inventor: Lloyd J. Byer, Centerville, Iowa

[73] Assignee: Wells Manufacturing Company, Fond du Lac, Wis.

[21] Appl. No.: 193,216

[22] Filed: Feb. 8, 1994

[51] Int. Cl.[6] ..... B65D 21/02

[52] U.S. Cl. ..... 206/504; 40/312; 206/509; 206/459.5; 220/234; 220/23.6

[58] Field of Search ..... 206/232, 470, 508, 509, 206/504, 511; 229/2.5 R; 220/23.4, 23.6, 23.83, 23.86, 339; 40/312

[56] References Cited

U.S. PATENT DOCUMENTS

| | | | |
|---|---|---|---|
| D.331,361 | 12/1992 | Langolf . | |
| 3,112,966 | 12/1963 | Reid | 40/312 X |
| 3,369,658 | 2/1968 | Hasselmann | 220/23.4 X |
| 3,374,917 | 3/1968 | Troy | 220/23 A |
| 3,381,850 | 5/1968 | Haugen | 220/339 |
| 3,384,265 | 5/1968 | Frank | 206/508 |
| 3,489,313 | 1/1970 | Haugen | 220/339 |
| 3,642,337 | 2/1972 | Manheim | 220/23.4 X |
| 3,721,339 | 3/1973 | Seyer . | |
| 3,874,579 | 4/1975 | Holden, Jr. | 229/2.5 R |
| 4,061,241 | 12/1977 | Retelny | 206/508 X |
| 4,202,464 | 5/1980 | Mohs et al. | 220/339 |
| 4,491,231 | 1/1985 | Heggeland | 206/509 X |
| 4,505,404 | 3/1985 | Perchak et al. | 220/339 |
| 4,660,723 | 4/1987 | Dechirot . | |
| 4,724,914 | 5/1988 | Klein . | |
| 4,739,883 | 4/1988 | Mohs et al. | 206/470 X |
| 4,848,542 | 7/1989 | Burnette et al. | 206/45.14 X |
| 4,903,827 | 2/1990 | Phelps et al. . | |
| 5,012,928 | 5/1991 | Proffitt et al. | 206/508 |
| 5,183,159 | 2/1993 | Hojnacki et al. . | |

FOREIGN PATENT DOCUMENTS

| | | | |
|---|---|---|---|
| 2606748 | 5/1988 | France | 206/508 |

*Primary Examiner*—Bryon P. Gehman

*Attorney, Agent, or Firm*—Andrus, Sceales, Starke & Sawall

[57] ABSTRACT

A product display package includes a formed transparent display enclosure such as a blister-type container having a back section and a front section. Each section is generally a rectangular-dished element with sections having abutting edge flanges defining a box-like container for holding and displaying a product. The front section has a front wall including an outwardly embossed logo. The logo has a unique coloring for enhanced display. The back section has a flat back wall including a recess aligned with the embossed logo. In stacked relationship, the logo of a back package protrudes into the recess in the back wall of the abutting front package to provide a compact stacked assembly of the packages. A card insert within the back section abuts the back wall and top wall of the back section. The top wall of the front section has an inward projection abutting the edge of the card top wall to hold the card in place. An in-line fabricating line includes a mold station to form a plurality of packages back and front sections coplanar and joined by a hinge connection. A silk screening station coats the logo on the packages, with an ultraviolet energy unit drying the coating. A die cut station separates the final packages which are then stacked for storage and transport.

18 Claims, 3 Drawing Sheets

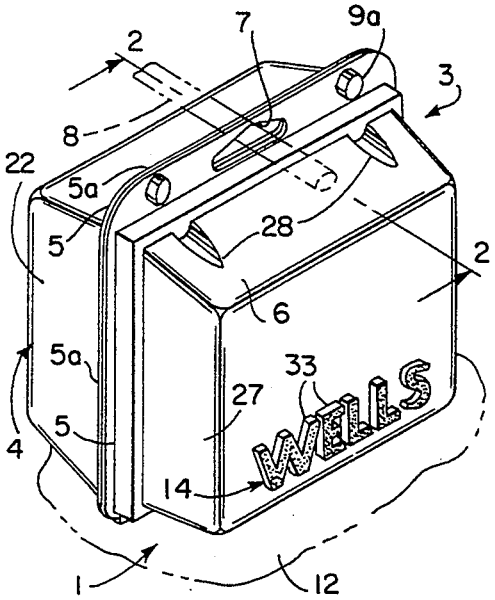
FIG. 1
FIG. 2
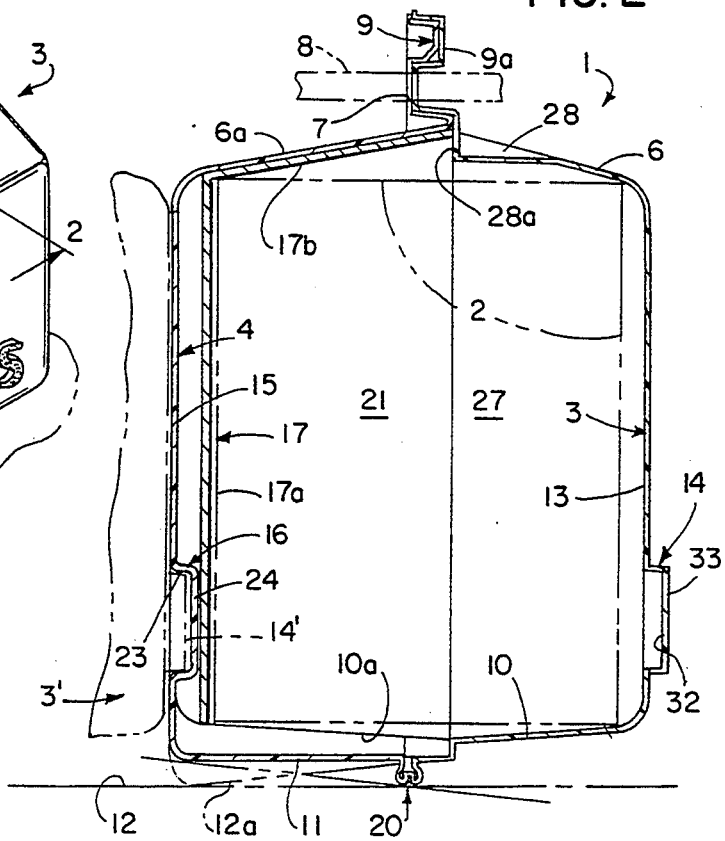
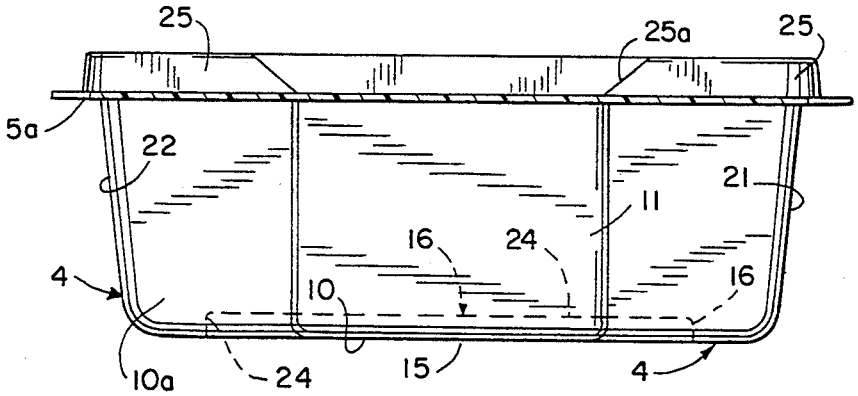
FIG. 5
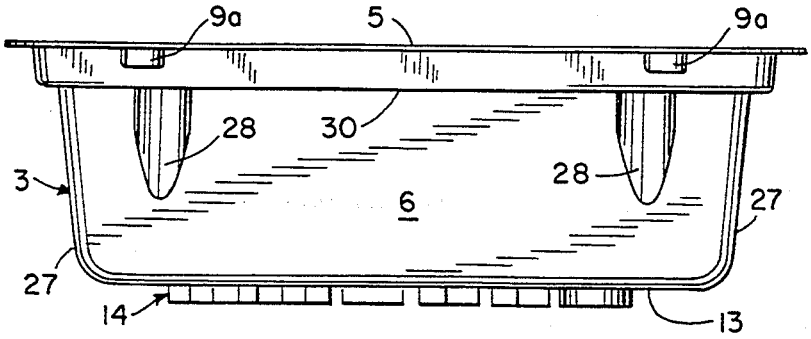
FIG. 6

PRODUCT PACKAGE WITH MATCHING INDICIA AND RECESS

BACKGROUND OF THE INVENTION

The present invention is particularly directed to a product package suitable for display of a product in the retail marketplace and particularly for convenient assembly of a plurality of such packages.

Various product packages are created for direct display of the product in a store or other commercial marketing facility. The package incorporates display openings and/or an outer transparent plastic shell portions for purposes of display of the product within the package. The packages may be held in a hanging position on a rod-like support, mounted in adjacent relationship on a display rack or other suitable sales display stand adapted to hold a plurality of the packaged products in superposed relation. For example, a particularly satisfactory blister-type display package which is adapted for supporting a plurality of packaged products on a rod member or standing in adjacent relationship on a display stand is disclosed in United States Design Patent No. D331,361 which issued Dec. 1, 1992 and is assigned to the assignee of this application. The patented product package is a thermal molded package including back and front sections with an intermediate abutting and interconnected flange structure. The upper portion of the flange includes an opening for hanging of the package upon a rod-like support. The bottom of the package's back section is provided with leg structures to permit standing of the package on a supporting shelf or other similar display areas. In practice, the package is vacuum molded of a clear see-through plastic. The product within the package is exposed, preferably with suitable identifying display and instructional sheets enclosed within the clear package to provide an informative and attractive display of the package and product.

Various other packaging systems have been used for display of packaged products such, for example, as shown in U.S. Pat. Nos. 4,742,914 which issued May 10, 1988; 4,660,723 which issued Apr. 28, 1987 and 3,721,339 which issued May 20, 1973.

In all such packaging systems, convenient compact storage and display of the assembly is desirable to provide for maximum storage of the components in minimum space. Thus, for example, U.S. Pat. No. 3,721,339 discloses a blister-type package with the packaged elements secured in vertical offset relation on a supporting card. Each blister package is formed or held effectively within an aperture within a base support card, with half of the member projecting forwardly and the other half projecting rearwardly. The offset allows the hanging of the packages on a support rod with the packages on adjacent boards vertically overlapped to minimize the space requirements in an assembly of the packages. Such packaging does not provide for display on a display shelf or counter.

In all such packages, identifying information can be provided within the container such as discussed above in connection with the assignee's design patent. In addition, of course, identifying labels can be applied to the exterior of the package if it is desired to more fully expose the product. Thus, the display of the packaged product with appropriate information is significant.

The manufacturer or seller often prominently displays a trademark such as the name or other identifying logo with the package and product in such a manner that it is readily recognized by the customer, and the customer will thereafter recall the trademark source. The trademark is generally applied using an internal cardboard or an external label member which is adhesively or otherwise affixed to the outside of the package, but may also be formed on a surface of the package.

Although various blister-type packages have been provided, there is a need for an improved packaging which will further promote the product display and particularly in such a manner as to permit use of the trademark or the like for promoting the product sale to customers.

SUMMARY OF THE PRESENT INVENTION

The present invention is particularly directed to an improved product display package unit which is suitable for product display with the packages in assembled stacked relationship. The product display package unit is further constructed with an outwardly protruding embossed trademark, other source identification or the like, with the package constructed for convenient compact and stabilized stacking of the packages for shipment and display. The optimum construction permits a hanging display from a suitable rod-like member or a standing on a suitable display shelf, counter or like stand with the elements in close abutting compact relationship.

Generally, in accordance with the teaching of the present invention, the product display package includes a formed transparent display enclosure such as a blister-type container having a back section and a front cover section defining a box-like container or receptacle within which the product is held. In accordance with the present invention, the front display portion of the product display package includes an outwardly embossed portion or member preferably including a source identification such as the corporate name or logo of the source or other sales promotional material. The embossed portion includes significant projection of the source identification from the front wall of the cover and is preferably provided with a unique coloring or the like to more fully set forth the embossed material. The back wall of the display package has a rearwardmost planar portion aligned with the front wall embossed member. The planar back wall includes an offset portion such as an opening or recess precisely aligned with the embossed material of each display package such that in stack relationship, the embossed member of the trailing package protrudes into the immediate adjacent front package to provide a compact stacked assembly of the packages.

The embossed and recessed members provide a very convenient assembly of the display packages with the identifying embossed portion interconnected to each other to stabilize the assembly while permitting the convenient releasable separation of the forwardmost package. At all times, the source identification is uniquely and prominently displayed.

In a preferred structure, a rectangular embossed member and generally corresponding recess portion were used. The members formed a relatively small portion of the front wall and the outer surfaces of the embossed data was screened with a color coating to prominently set forth the data. The front and back wall sections are preferably formed of a similar depth to locate the hanging structure generally centrally of the unit, with a supporting stand structure in the rear or back section of the package, generally as shown in the previously identified design application. The front wall is preferably formed with a recessed rim portion which is adapted to mate with a raised rim portion formed on the back member to further strengthen the packaging adjacent the central portion thereof and establish and maintain a relatively rigid plastic package. Suitable strengthening channel members or portions can be formed in various walls of the package to establish improved rigidity of the package walls.

The package is conveniently and preferably formed as a blister package using a thin plastic of a self-supporting rigidity which is pressure and vacuum formed into front and back wall sections of a dished construction.

The package is formed as a blister-type package in a continuous forming line. The front and back wall sections simultaneously formed in side-by-side orientation and with a connecting portion along the bottom edges in a suitable pressure and vacuum forming machine. The embossed trademark or the like is formed therein in the front cover section. The formed connected sections are transferred to a coating station in which a selected coating is applied to the outer surface of the embossed raised trademark, and the coating dried to complete the blister package. The formed containers are die cut to remove extraneous plastic and are then stacked in the opened condition for feeding through a packaging line.

This invention provides a convenient and cost effective packaging unit for appropriate display of products, with prominent display of an identification member in a compact and stabilized display assembly. The package unit is preferably formed in a single line including a thermoformer, a coating application and coating dryer, a die cutting station and a stacking station.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is an isometric view of a product display package illustrating an embodiment of the present invention;

FIG. 2 is a vertical section taken generally on line 2—2 of FIG. 1, with a fragmentary portion of an adjacent package shown in abutting relationship;

FIG. 5 is an end view taken generally on line 5—5 of FIG. 3;

FIG. 6 is an end view taken generally on line 6—6 of FIG. 3;

DESCRIPTION OF THE ILLUSTRATED EMBODIMENT

Figure 3:
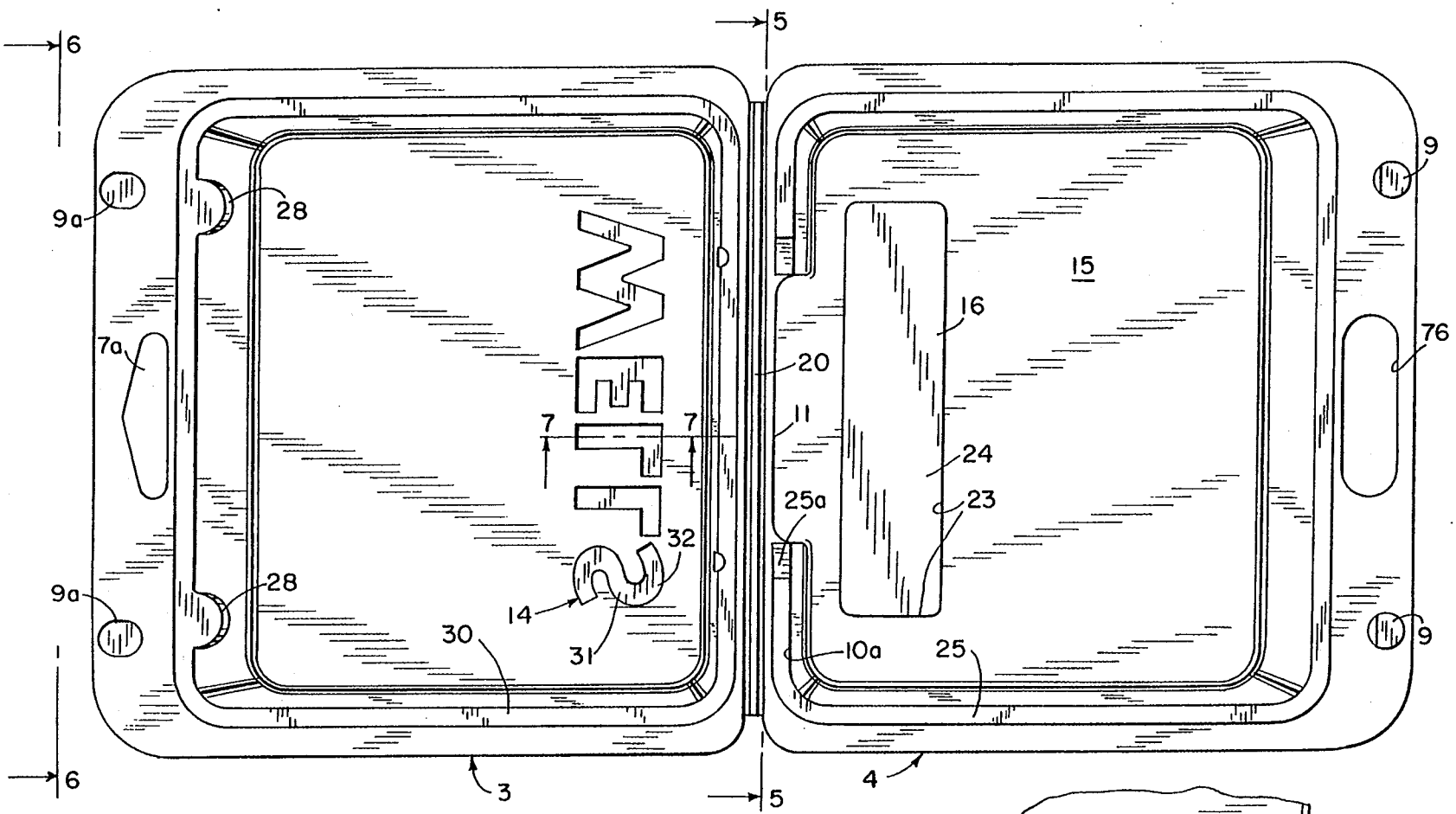
FIG. 3 is a top view of the package shown in FIGS. 1 and 2 in an open position of the package shown in FIGS. 1 and 2.
Figure 7:
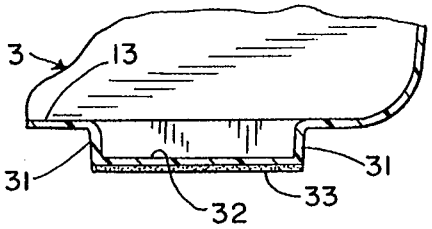
FIG. 7 is an enlarged fragmentary view of a portion of the package.

Referring to the drawings and particularly to FIGS. 1 and 2, a generally elongated rectangular package unit 1 is illustrated for housing of a product 2, (shown in phantom only in FIG. 2), such as an automobile tune-up kit. The package unit 1 includes a front or cover section 3 and a back section 4. Each of the front and back sections 3 and 4 are shown as generally similar dish-like members having similar outer encircling flanges 5 and 5*a*, respectively, secured in the closed abutting relation. The top flange portions or members project upwardly on a top wall 6 and 6*a* of sections 3 and 4, and are somewhat larger than the side and bottom flange portions or members. The top flange members are provided with aligned openings 7 for supporting of the package on a supporting rod 8, as shown in FIG. 2. The one opening is shown having an inverted V-shaped top edge for hanging of packages 1 centrally arranged on the support rod 8. The scope and size of the opening may be as illustrated, or of any other desired configuration related to a hanging support. The top flange members further include a pair of interlocking projections and recesses 9 and 9*a* to the opposite sides of the opening to hold the package closed. The bottom walls 10 and 10*a* of the package 1 has the relatively small bottom flange portion or member, generally similar to the side flanges. In addition, the back section 4 includes a support wall 11 formed and projecting downwardly within the bottom wall 10; shown as centrally located of the package unit 1. The support wall 11 is adapted to support the package on a flat support stand 12 with the back wall 10*a* slightly angled rearwardly, as shown in FIGS. 1 and 2. In FIG. 2, the unit is shown supported on the rod 8 with wall 11 at a slight angle from a stand 12. If placed on stand 12, wall 11 would drop onto stand 12 and support the package with a slight back tilt, as at 12*a*.

In accordance with the present invention, the front wall 13 of the front section 3 includes a significant outward embossed member 14, shown as a source identification, "WELLS" the assignee's corporate name and in the present instance. Further, as illustrated most clearly in FIGS. 3 and 4, the back wall 15 of the back section 4 is provided with a recess 16 of a depth which is preferably at least equal to the depth of the embossed identification member 14 on the front wall 13. The member 14 and recess 16 are similarly located such that with the package 1 and an adjacent package 3' in stacked abutting relation, as shown in FIG. 2, the embossment member 14' projects inwardly into the recess 16 to provide for compact and stabilized stacking during storage, shipment and/or display. The compact arrangement is maintained whether the stack of packages 1 is hung on the rod-like support 8 or supported on a flat display structure such as a display shelf 12 in a marketing environment. The blister-type package with the embossed portion and mating recess is particularly significant in product marketing and is readily produced as a cost-effective unit, as more fully developed hereinafter.

Package 1 is preferably formed of a suitable clear transparent material to expose the inner packaged product 2. Suitable product explanation, as shown only in FIG. 2, may be assembled with the package such as an identification and information card 17 inserted into the package. Card 17, shown as a generally L-shaped card having a first member or portion 17*a* corresponding to the back wall and a top portion 17*b* corresponding to the top wall 6*a* of the back section 4. Additionally, a suitable product identification label, not shown, or the like can also be adhesively applied to the exterior, or interior, of the package sections 3 and/or 4.

Figure 4:
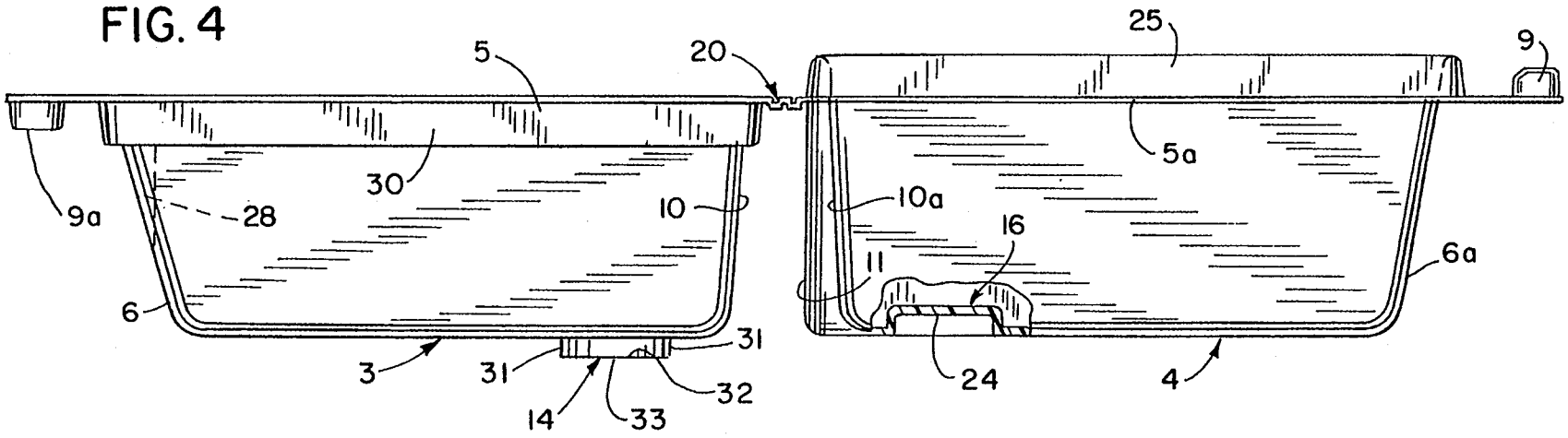
FIG. 4 is a side view of the package shown in FIGS. 1 and 2 in an open position as an original vacuum formed container.

More particularly, the illustrated embodiment of the unique package unit 1 and particularly the front and back sections 3 and 4 are preferably pressure and vacuum formed of a suitable plastic, with the front and back sections 3 and 4 interconnected along the bottom edge flanges 5 and 5*a* by an integral interconnection hinge member 20, as most clearly shown in FIGS. 2–4. The package 1 may be formed of any suitable plastic material. Applicant has found that PVC plastic provides a particularly satisfactory packaging for automobile products such as coils, pressure switches, and the like.

The back section 4, as shown in FIGS. 3–5, is preferably formed with the planar back wall 15 integrally molded with top wall 6*a*, bottom wall 10*a* and side walls 21 and 22. The top, bottom and side walls are slightly tapered, extending inwardly from the central flange 5*a* to the planar back wall 15. The stacking and stabilizing recess 16 is integrally formed in the back wall 15 with essentially straight side walls 23 and an inner bottom wall 24. The recess configuration is related to the embossed member 14 and, as more fully discussed hereinafter, has a depth and overall perimeter dimension slightly greater than that of the embossed member 14 to provide complete and close stacking of packages 1. The width of recess 16 is slightly less than the width of the back wall and the top-to-bottom length is substantially smaller than the back wall length. Similarly, the vertical stand or support portion 11 is integrally molded and projects outwardly within the bottom wall 10*a*. In the illustrated embodiment, a single stand 11 is formed centrally of the width of the bottom rim as an outward enlargement spanning substantially fifty percent of the bottom wall. Multiple stands/portions may be provided.

The flange 5*a* of the back wall section 4 is shown including a coupling rim 25 which extends outwardly of the flange and has a generally rectangular cross section, as most clearly shown in FIGS. 3–5. Rim 25 is offset inwardly of the outer edge of the flange 5*a* and in alignment with the side walls of the rear section. The coupling rim 25 is removed within the bottom wall portion which includes the stand member 11, as at 25*a* in FIG. 5.

The front wall section 3 is formed of an essentially similar structure and configuration as the back wall section 4 in the illustrated embodiment. Thus, section 3 includes the flat front wall 13 integrally molded with tapered side walls 27, tapered bottom wall 10 and tapered top wall 6 to form a total enclosure member. The top wall 6 is provided with at least one inward surface projection 28 with the end adjacent the flange wall 6 and forming a slight inward projection which acts as a stop member or wall 28*a*. Two members 28 are shown. The stop members 28*a* are located just inwardly of the top flanges 6 and 6*a*, and in the closed package are aligned with the edge of the top wall of the card 17, as shown in FIG. 2. The wall 28 is inclined slightly, as most clearly shown in FIG. 4, to locate and capture the card edge. The members 28*a* thus serve to support the card 17 in proper location within the package.

The inclined walls 6, 10 and 27 are secured to the encircling planar flange 5 by a stepped recess 30 located to mate precisely with the rim 25 of the back section 4. Thus, the connecting recess 30 has an L-shaped configuration essentially corresponding to the outer wall structure of the rim 25.

The package, with the raised ledge 30 and rim 25 and the projections 9 and 9*a*, permit stacking of the formed packages for subsequent introduction of product in a filling line. Thus, the above elements hold the adjacent packages in a stack separated whereby the stacked packages may be separated mechanically within a product insertion line without necessity for any special molded or other denesting element.

The embossed member 14 is formed, in the illustrated embodiment of the invention as shown in FIGS. 1–4, 6 and 7, on the front wall 13 as an integrally pressure and vacuum formed projection. Thus, the illustrated projection consists of the five letters spelling WELLS corresponding to the basic name of the assignee. Each of the embossed letters is formed with substantially straight side walls 31 projecting substantially outwardly from the planar wall 13. Integral flat front walls 32 are connected to the side walls 31 to complete the presentation. The projecting walls 31 and 32 define the outline of the several letters of the word. The surface of the front walls 32 preferably will be provided with a suitable distinctive coloring or the like, as shown at 33 in the enlarged view of FIG. 7, to clearly and distinctively present the source identification within the boundaries of the planar front wall 13. The front walls 32 may be conveniently silk screened with a suitable color coat 33 within the forming apparatus. The maximum forward projection of the identification member 14 is preferably slightly less than the depth of the recess 16 to ensure optimum abutment of the front and back walls of the sections, as shown in FIG. 2. The illustrated embodiment, with the planar front and back walls as well as similar projections with the embossed member 4, is not critical but is preferred.

Thus, in a practical design, the WELLS identification member 14 is provided in a particular package having an overall center chamber length of approximately 4.000 inches in length and 4.250 inches in width. The package has a depth of approximately 2.625 inches between the front and back walls. The recess configuration had a height of approximately 0.140 inches and a width of approximately 2.750 inches. The WELLS logo identification member 14 had a height of approximately 0.125 inches and an overall length of 2.625 inches.

Generally, such dimensional configuration will vary with the particular product and package and does not constitute effective dimensional limitations on package structures within the teaching of the present invention.

Figure 8:
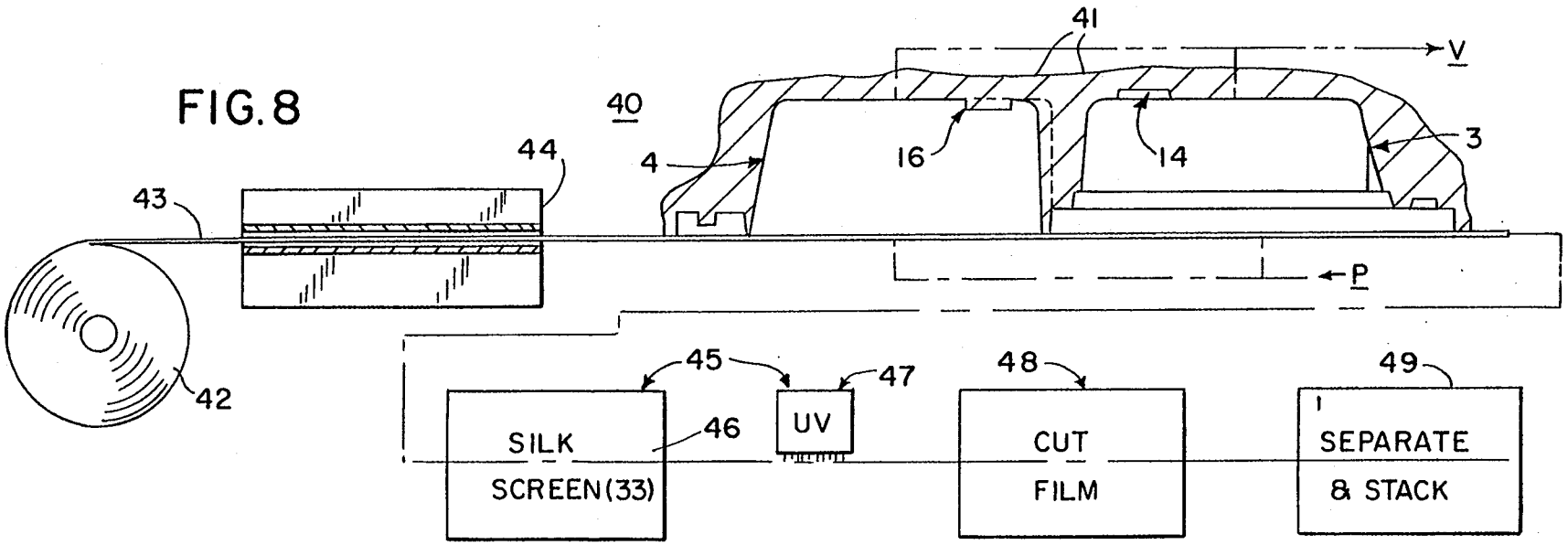
FIG. 8 is a diagrammatic view of an in-line fabrication line illustration of the forming of a plurality of the packages shown in FIGS. 1–7.

The package can be formed in any suitable apparatus with the projecting logo or other identification member 14 preferably specially treated to provide the unique presentation such as by a color coating 33. FIG. 8 illustrates a preferred system wherein an in-line fabricating system is provided for forming and completing packages for subsequent use.

In FIG. 8, a mold station 40 is illustrated having a mold corresponding to the shape of the final package, as shown for example in FIG. 4. In practice, the mold unit 41 may include a plurality of the molds to simultaneously produce a plurality of the packages in a single molding strip. A film supply 42 is located to supply the plastic sheet 43 into the fabricating line in a stepped sequence establishing a dwell period of the film plastic sheet 43 in each period. A heating unit 44 is interposed between the supply 42 and the mold station 40 to heat the plastic sheet 43 to an appropriate temperature for molding. With a heated sheet portion located within the mold unit 41, pressure and vacuum (as at P and V) is applied to simultaneously form one or more of the packages with suitable edge interconnections and extended outer edges in accordance with known fabrication. A pressure and vacuum molding apparatus can be readily provided in accordance with known technology. The formed film is stepped from the mold station to a coating station 45. In a particularly practical application, the front wall face 32 of the logo member 14 is coated with a suitable color coating 33 by a suitable silk screening unit 46, during the dwell period. The coating is then dried. An ultraviolet light drying unit 47 is mounted immediately downstream of station 45. During the next step, the coated plastic sheet is moved through unit 47 into a cut and trim station 48. The UV light unit 47 applies UV light immediately to the silk screened coating 33 as the film moves from unit 46 and provides instantaneous drying of the coating 33 on the plastic package. The formed film with the multiple packages is thus moved to the die cutting station 48 of a well known type for severing of each of the packages along the peripheral border and frames, with removed trim held to the edges of the packages by minute interconnections. The cut film is moved at the next step to a separating and stack station 49, where the individual packages are totally separated from the trim and stacked in stacks for subsequent use. The trim is rolled and returned for recycling into a film supply or the like. The stacked packages, not shown, are then readily usable in a subsequent filling machine wherein the product, cardboard inserts and the like are automatically inserted into the package and the package closed to provide the desired product display package.

Thus, the in-line silk screening and drying of the coating 33 as an integral part of the fabrication line combined with the cutting and stacking process provides a cost effective, and efficient method of forming the packages for subsequent usage. Obviously, if the products are ready for direct assembly, the packages may be fed directly into such a packaging line. In practice, however, it has been found that the formed packages are normally stacked for use in a separate product packaging line. As previously discussed, the packages as illustrated can be stacked without the necessity of usual denesting elements formed in each package.

Various variations of the package constructions may of course be provided within the basic structure of an enclosing package unit with an offset identification member appropriately and preferably located on front of the package with a corresponding recess unit provided on the back of the package.

The coloring of the member 14 may be internally or externally provided and may even consist of a completely separate insertion of a correspondingly shaped member or members inserted into the recessed portion provided by the integral molding of the identification member 14 to the front wall of the package.

The back recess 16 preferably consists of the simple elongated recess which is slightly larger than the identification member 14 formed on the front wall as shown. A mating recess or opening construction may be provided with the recessed portion essentially complementing that of the integrally forward molded member 14. The latter construction may require a more precise molding process and may not provide a cost effective construction as that illustrated.

Further, although identified as a source identification member 14, any other type of a presentation may be made. As used herein, a projecting identification member therefore refers to any projecting informational structure formed on the wall of a package including single or multiple elements in combination with a mating opening or recess in an abutting wall of a package for accommodating the same.

The preferred construction, as illustrated, provides for either hanging or standing orientation, with the central supporting hanging flange structure particularly desirable for supporting of the units in hanging relationship on a suitable hanging support member.

The present invention thus provides a product display package having a significant raised identification member and a suitable support structure for presenting of the packages in a superimposed stacked relationship.

Various modes of carrying out the invention are contemplated as being within the scope of the following claims particularly pointing out and distinctly claiming the subject matter which is regarded as the invention.

I claim:

1. A product display package unit for displaying a contained product within the package unit, comprising a semi-rigid outer wall structure for supporting and including a product, said wall structure including a front wall having an outwardly projecting identification member defining indicia on a small portion of said front wall, said wall structure having a back wall connected to said front wall by a side wall, said back wall having a planar portion defining the outermost location of said back wall and having an inwardly projecting opening matched in size with said outwardly projecting identification member, said opening being located within said planar portion, said outwardly projecting identification member and said opening being located and aligned so that plural ones of said product display package unit are adapted to be located in stacked relation with a front wall of a rear package unit adjacent the back wall of a front package unit and with said identification member of said rear package unit projecting into said opening of the front package unit.

2. A product display package unit as described in claim 1, including a top flange unit including a coupling member for suspension on a suspension support whereby plural ones of said product display package unit are adapted to be secured in substantial stacked adjacent relationship.

3. The product display package unit of claim 1, wherein said side wall includes a bottom wall, and including a product support stand integrally formed to and projecting outwardly of the bottom wall, said support stand being adapted to placing plural ones of said package unit as a stack of abutting package units on a support stand.

4. The product display package unit of claim 1, wherein said front and back walls are molded walls and said front wall includes a continuous planar wall portion including said identification member integrally embossed within said continuous planar wall portion and said opening includes a recess integrally embossed in said back wall.

5. The product display package unit of claim 4, wherein said identification member defines a substantially outwardly spaced outer wall surface in a generally co-planar relationship to said continuous planar wall portion, said outer wall surface having a distinctive treatment for more clearly presenting of said identification member on said package.

6. The product display package unit of claim 5, wherein said distinctive treatment includes a distinctive color coating.

7. A product display package forming a substantially closed enclosure for a product to be displayed, comprising: a front wall section having a front wall interconnected by side walls and a back wall section having a back wall interconnected by side walls, said front wall section and back wall section each being correspondingly dished-shaped and having abutting flanges on said side walls, said front wall section having a first outer surface and a source identification member defining indicia projecting outwardly on a portion of said first outer surface of said front wall to a second outer surface defining a substantially maximum extent of said front wall, said back wall having an inwardly projecting recess, said identification member and said recess being matched in size and located in precise alignment with said identification member on said front wall so that stacking of at least a first front said product display package and a second back said product display package includes said back wall of said first package substantially adjacent the front wall of said second product display package with said identification member of said second product display package located within said recess of said first product display package.

8. The product display package of claim 7, wherein said front and back walls are substantially flat planar walls and back and front walls of first and second product display packages abut in a stacked relation of a plurality of said product display packages to require minimum spacing for display and with said identification member and recess stabilizing interconnection of the first and second product display packages.

9. The product display package of claim 7, wherein said identification member defines an outward planar dimension slightly less than the depth of the matching recess.

10. A product display package for substantially enclosing a product for display, the product display package comprising a front wall section having a front wall and interconnected side walls and a top wall and a bottom wall, a back wall section having a back wall and interconnected side walls and a top wall and a bottom wall, said front and back wall sections each being a substantially dish-shaped structure having substantially identical shapes, each of said wall sections having an encircling flange extending laterally from said side walls, top wall and bottom wall, the flanges of said bottoms walls being interconnected to each other to form a hinge structure interconnecting said wall sections, said front wall and said back wall of each of said wall sections being substantially identically configured planar walls and adapted to be located in abutting relationship with said front and back walls of another said product display package in stacked relation, said front wall having an embossed identification member defining indicia projecting outwardly and located within a relatively small portion of said front wall, said back wall having an inwardly projecting recess matched in size to said identification member and located in substantial front-to-back alignment with said identification member on said front wall, said recess having a depth at least as great as the outward projection of said identification member so that said identification member of another said product display package is located within said recess with said product display packages in stacked relation.

11. The product display package of claim 10, wherein said embossed identification member has an outermost surface having a color display for enhanced presentation thereof.

12. The product display package of claim 11, wherein said front wall section and said back wall section are formed as a single integral member with said hinge structure integrally molded to the outer edges of the flanges on said bottom walls.

13. The product display package of claim 12, wherein said flanges of said top walls of said front and back wall sections are interconnected and include a hanging unit for hanging of said product display package with a common support, said bottom wall of said back wall section including a projecting supporting stand structure projecting downwardly from said bottom wall whereby said product display package can be supported on a planar display member, and whereby plural ones of said product display package can be supported as a stack on either said common support or said planar display member.

14. The product display package of claim 10, wherein said package back wall section and said front wall section are molded of a substantially clear plastic to totally expose an enclosed product, said embossed identification member being silk screened with a distinctive color presentation.

15. The product display package of claim 10, including at least one flat insert within said products display package and having a first part located in abutting relation with at least one of said front wall and said back wall and a second part extending inwardly from said first part to an outer edge and abutting said top wall of said corresponding section, the non-abutting top wall having at least one projection extending inwardly of said wall and engaging the outer edge of said at least one flat insert.

16. A product display package unit for displaying a contained product within the package unit in combination with informational material, comprising an outer wall structure including a first wall section and a second wall section each having a dish-shaped construction and located in abutting relation to form a box-shaped enclosure with substantially spaced back and front vertical walls connected by a top end wall and a bottom end wall, said top end walls abutting each other and said bottom end walls abutting each other at a seam, said box-shaped enclosure adapted to contain a product for sale, an informational card member having a first part covering said vertical wall of said first wall section between said bottom end wall and said top wall and a second part abutting and covering one of said top and bottom end walls of said first wall section and projecting from said first part and terminating in a card edge substantially in alignment with the corresponding seam between said first wall section and said second wall section, said one of said top and bottom end walls of the second wall section having at least one inward projection defining a stop wall engaging the card edge of said second part and thereby supporting said card member in said enclosure with said first part abutting said vertical wall and said second part abutting said inward projection.

17. The product display package of claim 16, wherein said projection forms a part of a strengthening rib formed in the end wall and said rib includes an integral end closure wall abutting said card edge.

18. The product display package of claim 17, including a plurality of said ribs.

* * * * *

UNITED STATES PATENT AND TRADEMARK OFFICE

CERTIFICATE OF CORRECTION

PATENT NO. : 5,411,140

DATED : May 2, 1995

INVENTOR(S) : Lloyd J. Byer

It is certified that error appears in the above-indentified patent and that said Letters Patent is hereby corrected as shown below:

CLAIM 15, Col. 10, Line 34, after "said" (first occurrence) insert ---top---.

Signed and Sealed this

Seventeenth Day of October, 1995

Bruce Lehman

*Attest:*

BRUCE LEHMAN

*Attesting Officer*

*Commissioner of Patents and Trademarks*